US008109714B2

(12) United States Patent
Keener

(10) Patent No.: US 8,109,714 B2
(45) Date of Patent: Feb. 7, 2012

(54) SEWAGE PUMP

(76) Inventor: Robert M. Keener, Ashland, OH (US)

( * ) Notice: Subject to any disclaimer, the term of this patent is extended or adjusted under 35 U.S.C. 154(b) by 1188 days.

(21) Appl. No.: 11/850,847

(22) Filed: Sep. 6, 2007

(65) Prior Publication Data

US 2009/0067992 A1 Mar. 12, 2009

(51) Int. Cl.
*F03B 11/00* (2006.01)

(52) U.S. Cl. ..... 415/121.1; 241/46.06

(58) Field of Classification Search ..... 415/121.1; 416/228, 231 A; 417/423.1, 424.1, 900; 241/46.06

See application file for complete search history.

(56) References Cited

U.S. PATENT DOCUMENTS 5,256,032 A * 10/1993 Dorsch ..... 415/121.1

6,224,331 B1 * 5/2001 Hayward et al. ..... 415/121.1

* cited by examiner

*Primary Examiner* — Edward Look
*Assistant Examiner* — Aaron R Eastman
(74) *Attorney, Agent, or Firm* — Alan Kamrath; Kamrath IP Lawfirm, PA

(57) ABSTRACT

A sewage pump is to mount a blade set coaxially mounted between a water paddle disk and a first wheel blade within the blade chamber, wherein the blade set comprises a stationary annular blade base and a movable second wheel blade. The second wheel blade is within the annular blade base fixed to an inner wall of the blade chamber. Particularly, the stationary blade base and the second wheel blade respectively have blade sheets facing toward each other. When the sewage pump is driven by its motor, the water paddle disk, the first and second wheel blades are rotated to cause a suction force to drive precipitation flow into the blade chamber via the precipitation inlet. The first wheel blade cooperates with a gear ring to perform a first smashing stage and then the blade set performs a second smashing stage to improve the smashing efficiency of the sewage pump.

6 Claims, 7 Drawing Sheets

SEWAGE PUMP

BACKGROUND OF THE INVENTION

1. Field of the Invention

The present invention relates to a sewage pump, and more particularly to a sewage pump that additionally comprises an auxiliary blade set so that the sewage pump performs a two-step smashing function to improve durability of the sewage pump, the breaking efficiency and the sewage draining efficiency.

2. Description of Related Art

Conventional sewage pumps as shown in FIGS. 1 and 2 each substantially has a central shaft 1 of a motor sleeved with a water paddle disk 2 and a wheel blade 3 that are driven to rotate by the driving of motor. The water paddle disk 2 has multiple paddle sheets arranged in whirl on its lower surface and is accommodated inside a paddle chamber 5 of a lower base 4. The wheel blade 3 has multiple blade sheets in a certain number and is mounted in a precipitation inlet 6 below the paddle chamber 5. Moreover, a gear ring 7 is attached on an inner wall of the precipitation inlet 6. A precipitation outlet 8 is defined at one side of the paddle chamber 5 to connect to a universal joint with drain pipe (now shown). By having the above-described structure, the central shaft 1 drives the water paddle disk 2 and the wheel blade 3 to rotate and to cause current suction function to drain the precipitation via the precipitation inlet 6 below the paddle chamber 5 when the motor of sewage pump operates. Meanwhile, the wheel blade 3 cooperates with the gear ring 7 to smash and scatter the precipitation and then the paddle sheets on the water paddle disk 2 push the precipitation to the precipitation outlet 8 to drain out via the drain pipe. Therefore, the precipitation on a bottom of the sewage tank can be eliminated.

However, the conventional sewage pump can not perform sufficient smashing efficiency and some large precipitation pieces stick to the water paddle disk 2 because only one stage of smashing by the wheel blade cooperating with the gear ring is short in processing period and insufficient to completely smash the precipitation. Therefore, the large pieces of the precipitation get stuck to the paddle sheets of the water paddle disk 2. Thus, the precipitation can not be drained out smoothly and the operation of the water paddle disk 2 is interrupted. In these cases, the smashing efficiency is reduced and malfunction rate is increased.

Additionally, still another conventional sewage pump as disclosed in U.S. Pat. No. 7,159,806 has a wheel blade mounted in the precipitation inlet on the lower base of the pump to smash and scatter the precipitation sucked into the sewage pump. Although the wheel blade operates upward and downward in reciprocation when smashing, the efficiency is still poor and the precipitation can not be smashed and eliminated completely.

SUMMARY OF THE INVENTION

A main objective of the present invention is to provide a sewage pump that performs a two-step smashing process before precipitation is conducted into a paddle chamber to ensure no coagulation of precipitation and to make the precipitation drain out easily to improve operational efficiency of the sewage pump.

Another main objective of the present invention is to provide a sewage pump that comprises an additional auxiliary blade set to achieve the two-step smashing process to efficiently eliminate problems of precipitation blocking to the paddle sheets on the water paddle disk so that the operational efficiency can be maintained and thus the malfunction possibility is reduced.

To overcome the foregoing main objectives of the sewage pump in the present invention, the sewage pump comprises:

a motor providing the power and having a central axle;

a lower base with a blade chamber attached to the motor and having an inlet and an outlet defined in the lower base to communicate with the blade chamber;

a water paddle disk received inside the blade chamber and mounted on the central axle;

a gear ring attached to the inlet and a first wheel blade accommodated inside the gear ring and mounted on the central axle;

an auxiliary blade set mounted between the water paddle disk and the first wheel blade and comprising:

a stationary blade base with a through hole attached to the lower base over the inlet; and a second wheel blade accommodated inside the through hole of the stationary blade base and mounted on the central axle, thereby, the second wheel blade is driven to rotate synchronously with the water paddle and the first wheel blade by the central axle of the motor.

By adding the auxiliary blade set, the two-step smashing function is achieved.

Further benefits and advantages of the present invention will become apparent after a careful reading of the detailed description with appropriate reference to the accompanying drawings.

DETAILED DESCRIPTION OF THE PREFERRED EMBODIMENT

Figure 2:
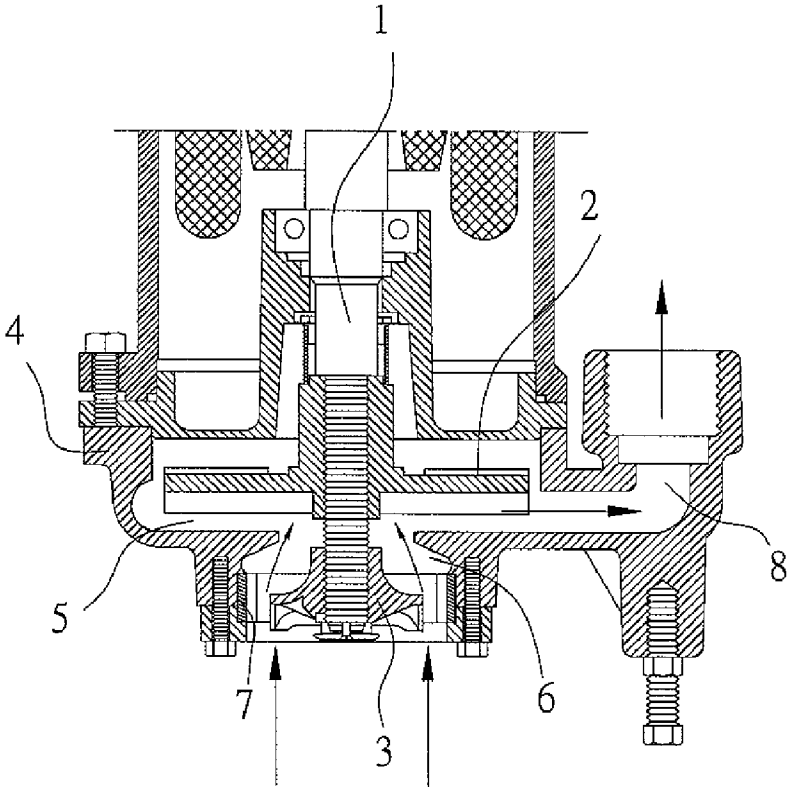
FIG. 2 PRIOR ART
FIG. 2 is a partially cross-sectional side view of another conventional sewage pump in accordance with the prior art.
Figure 1:
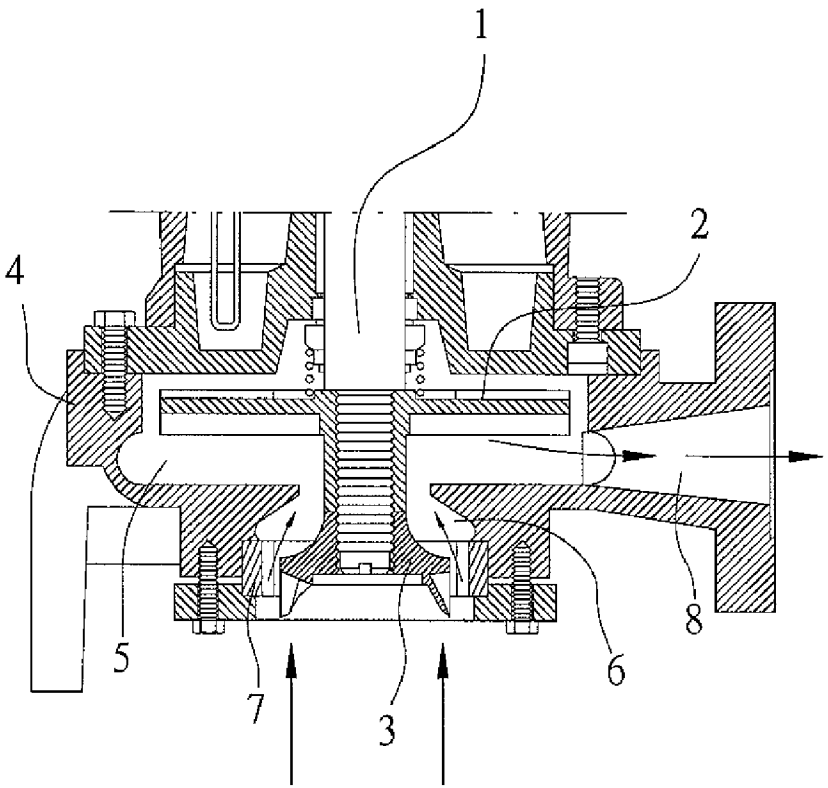
FIG. 1 PRIOR ART
FIG. 1 is a partially cross-sectional side view of a conventional sewage pump in accordance with the prior art.
Figure 3:
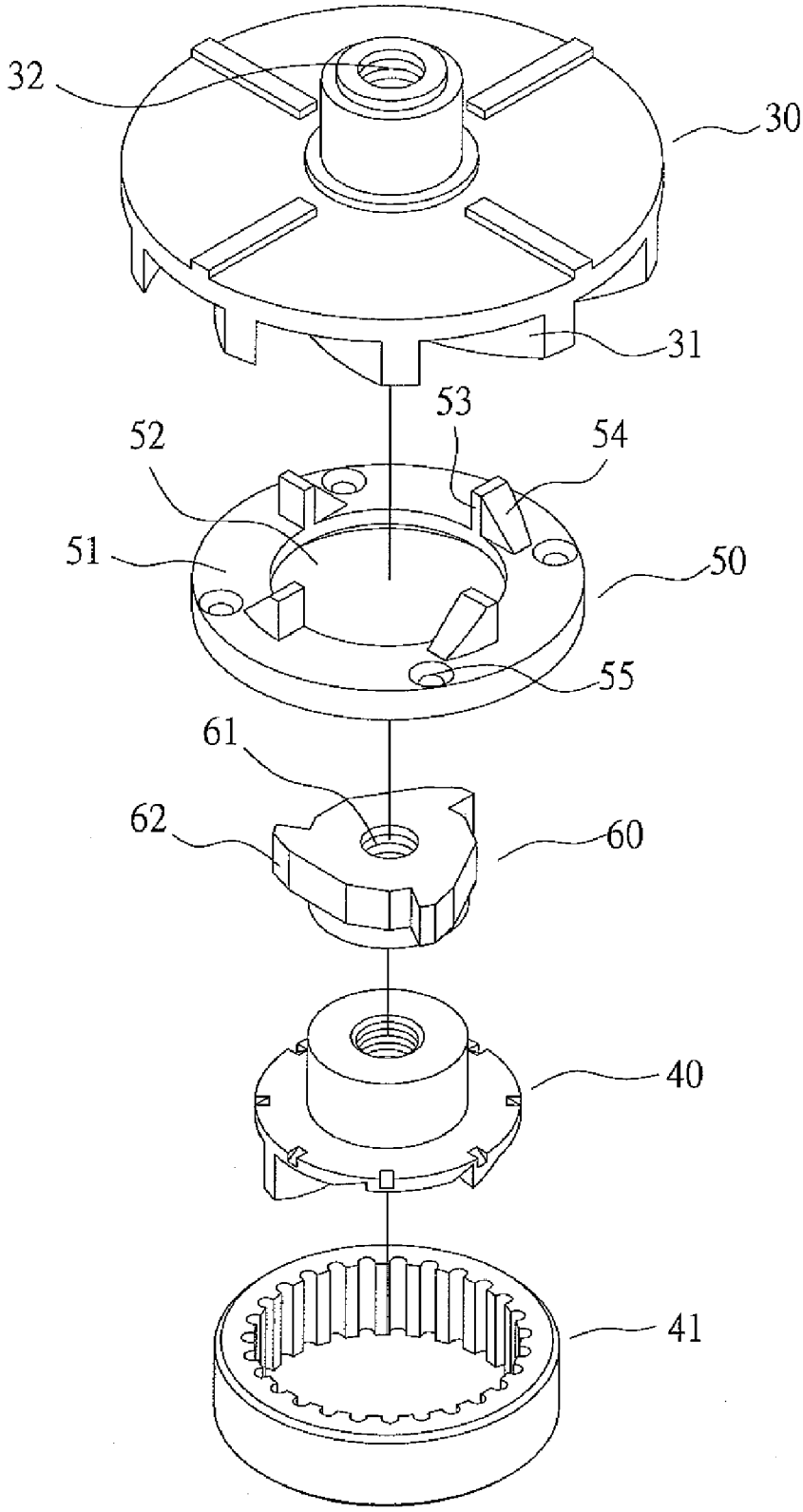
FIG. 3 is an exploded perspective view of two blade sets with a water paddle disk in a sewage pump in accordance with the present invention.
Figure 4:
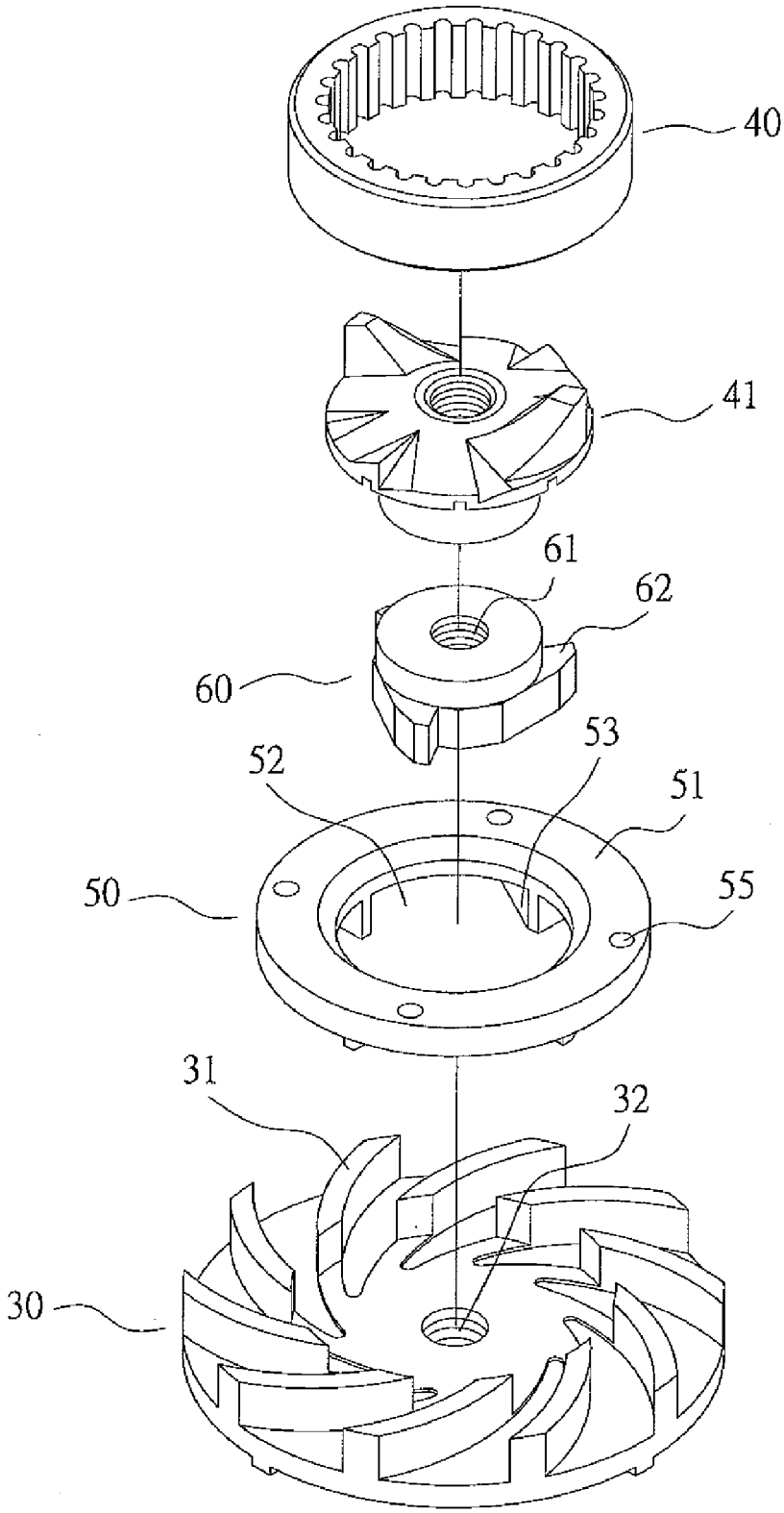
FIG. 4 is an exploded perspective view of the blade sets with the water paddle disk of FIG. 3, wherein those elements are placed reversely.

A sewage pump in accordance with the present invention is to mount an additional auxiliary blade set between a water paddle disk and a first wheel blade within the blade chamber, wherein the blade set comprises a stationary annular blade base and a second wheel blade. The stationary annular blade base is mounted on a diameter-enlarged recess in a lower base over an inlet of precipitation. The second wheel blade is rotatably received in the stationary annular blade base.

Thereby, the water paddle disk, the first and second wheel blades are coaxially and synchronously driven by a motor shaft. Meanwhile, an upper edge of the stationary annular blade base and a side periphery of the second wheel blade respectively have blade sheets in certain predetermined numbers. When the sewage pump is driven by its motor, the water paddle disk, the first and second wheel blades are rotated to cause a suction force to drive precipitation at the bottom of the sewage pump flow into the blade chamber via the precipitation inlet. The first wheel blade cooperates with a gear ring to perform a first smashing stage and then the auxiliary blade set performs a second smashing stage to improve the smashing efficiency of the sewage pump.

With reference to FIGS. 3 to 9, the sewage pump of the present invention comprises a pump 10, a lower base 20 with a blade chamber 21 mounted to a bottom of the pump 10, a water paddle disk 30 and a first wheel blade 40 with a gear ring 41 received inside the blade chamber 21, and an auxiliary blade set mounted between the water paddle disk 30 and the first wheel blade 40.

Figure 8:
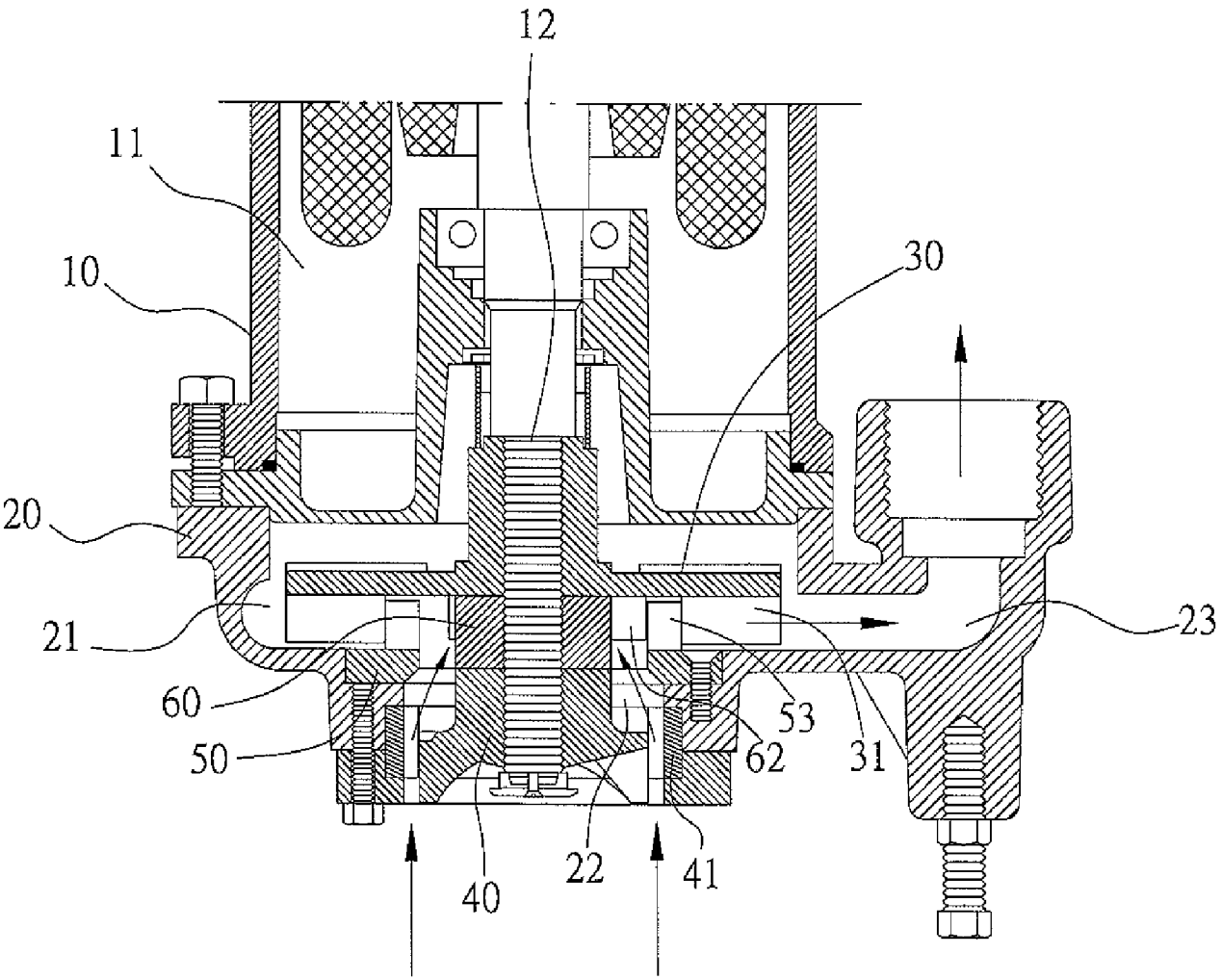
FIG. 8 is an operational view of the blade sets with the water paddle disk in the sewage pump with one drain pipe.
Figure 9:
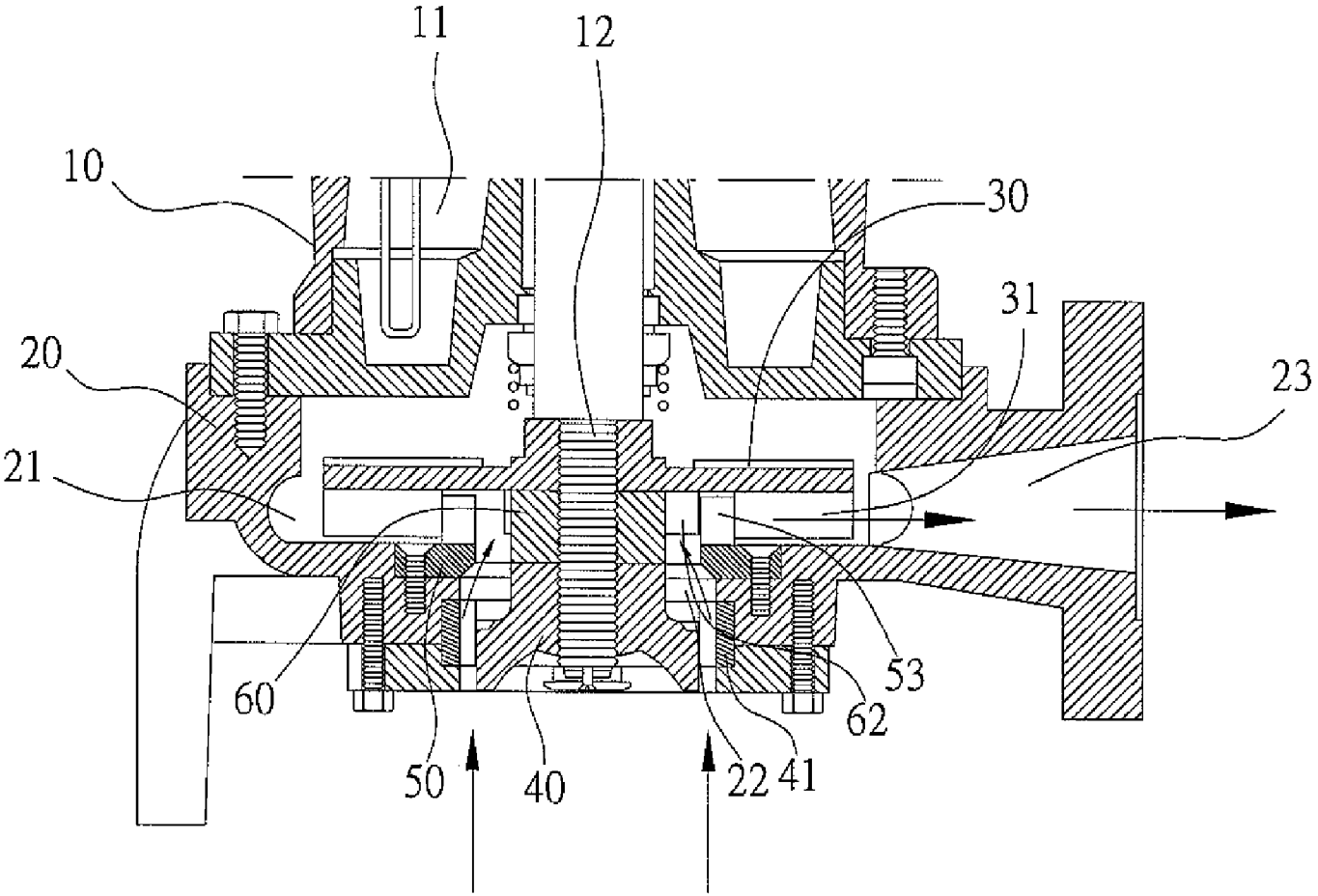
FIG. 9 is an operational view of the blade sets with the water paddle disk in the sewage pump mounted with another drain pipe.

The pump 10 has a motor 11 with a central axle 12 penetrating the water paddle disk 30, the auxiliary blade set and the first wheel blade 40. The pump 10 is mounted on the lower base 20 by screws. The lower base 20 is hollow to perform the blade chamber 21 and has a lower port with a precipitation inlet 22. The gear ring 41 is attached to an inner periphery of the lower port and aligns with the first wheel blade 40 in horizontal. The first wheel blade 40 is coaxially mounted with the water paddle disk 30 and the auxiliary blade set by the central axle 12 so that the motor 11 is enabled to drive the water paddle disk 30 and the first wheel blade 40 synchronously. The first wheel blade 40 and the gear ring 41 respectively have multiple first blade sheets 42, 43 to perform a first smashing process to disintegrate the precipitation when the first wheel blade 40 rotates. Moreover, a precipitation outlet 23 is defined at a sidewall of the lower base 20 to communicate with the blade chamber 21 and mounted with a universal joint or a drain pipe (not numbered, as shown in FIGS. 8 and 9). By having the arrangement described above, when the motor 11 of the pump 10 actuates, the water paddle disk 30 and the first wheel blade 40 are driven synchronously to generate a current suction force to draw the precipitation in sewage tank (now shown) into the blade chamber 21 via the precipitation inlet 22. Meanwhile, the precipitation is smashed by the operation of the first wheel blade 40 with the gear ring 41 and then smashed precipitation is drained out via the precipitation outlet 23 and the drain pipe. Thereby, the precipitation in the sewage tank is eliminated.

Figure 5:
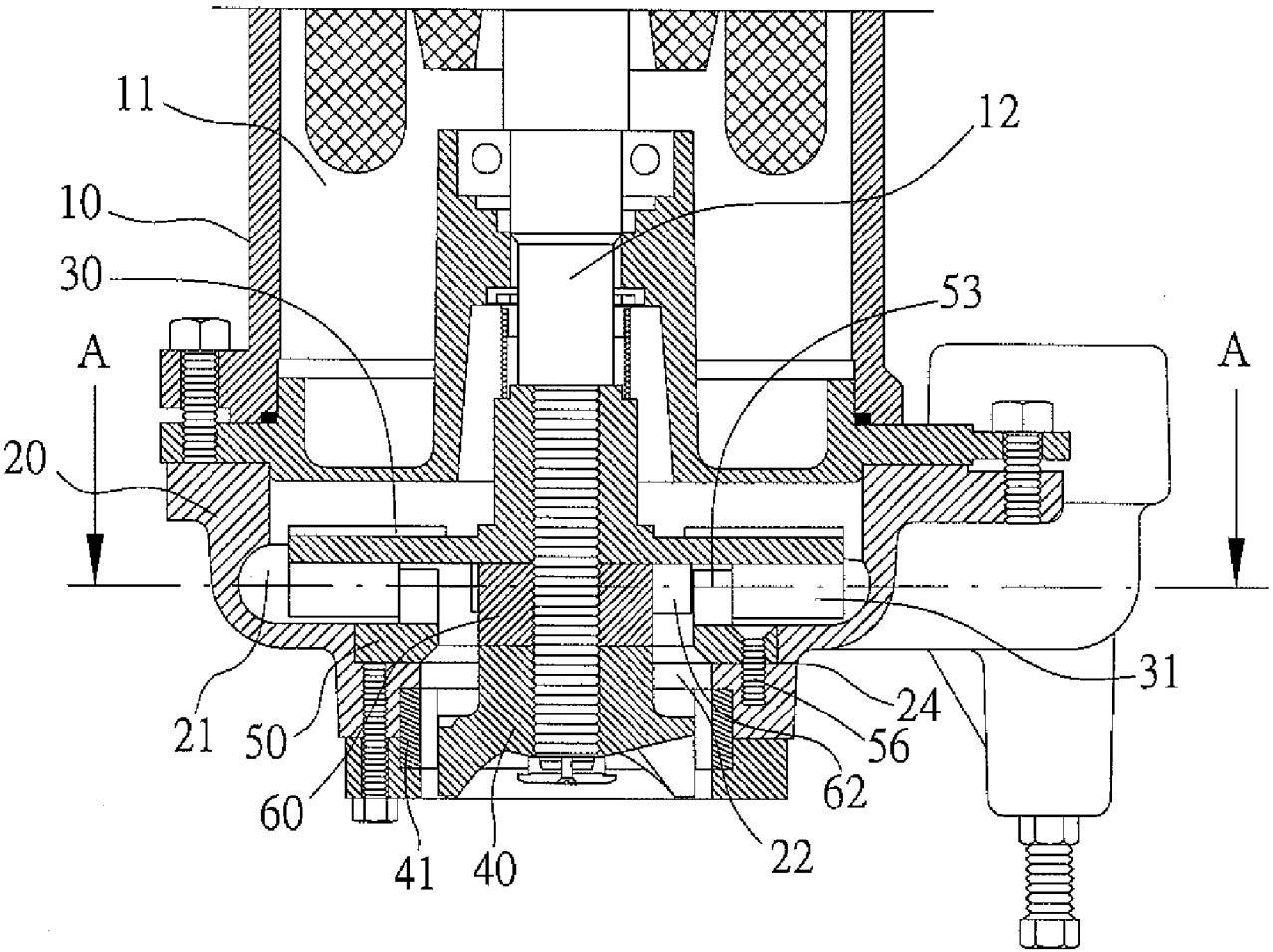
FIG. 5 is a cross-sectional side view of the blade sets with the water paddle disk of FIG. 3, wherein those elements are assembled.
Figure 6:
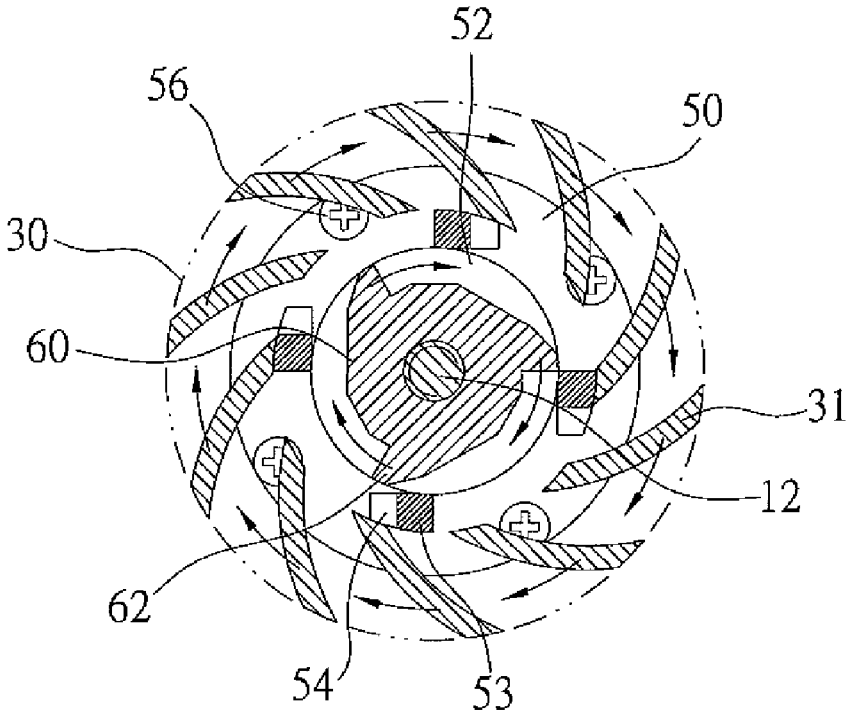
FIG. 6 is cross-sectional top view of the blade sets along line A-A as shown in FIG. 5.
Figure 7:
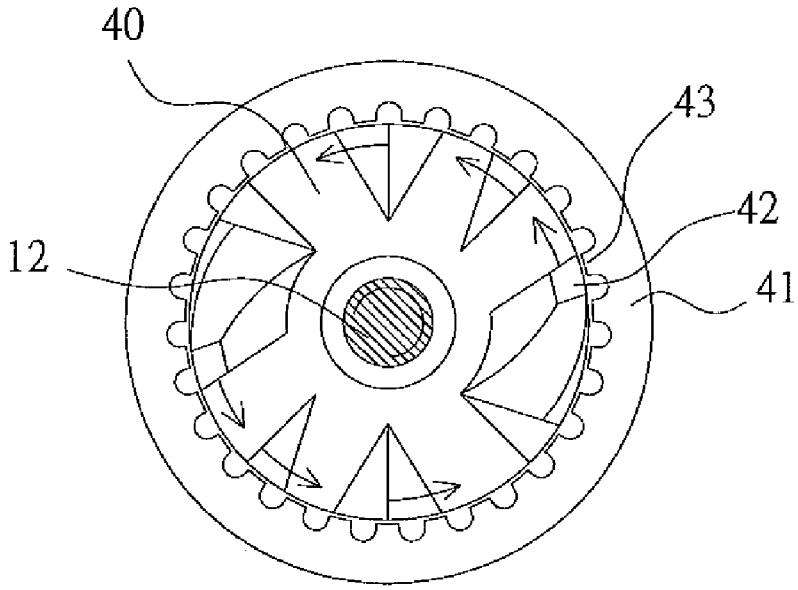
FIG. 7 is a cross-sectional view of a first wheel blade cooperating with a gear ring.

To improve the smashing efficiency, the sewage pump further has the auxiliary blade set mounted between the water paddle disk 30 and the first wheel blade 40 inside the blade chamber 21 of the lower base 20. The auxiliary blade set comprises a stationary annular blade base 50 and a second wheel blade 60. The annular blade base 50 is mounted at the lower port of the lower base 20 that particularly has a diameter-enlarged recess 24 snugly engaged to the annular blade base 50 for securing. The annular blade base 50 has a circular body 51 and a through hole 52 defined at its center and multiple blade sheets 53 formed at its top face in certain predetermined numbers. Each blade sheet 53 has a slope face 54 with a sharp inner edge facing and around the through hole 52. Moreover, multiple screws holes 55 are defined through the circular body 51 to make the stationary annular blade base 50 to be secured on the lower base 20 by screws 56. Because the blade sheets 53 of the stationary annular blade base 50 are formed on the top face adjacent to the water paddle disk 30, multiple paddle sheets 31 formed on a bottom face of the water paddle disk 30 in shape of vortex can not be located close to an axle hole 32 at the center but are spaced from the axle hole 32 with a distance that extends from the axle hole 32 to substantially close to an outer radius of the blade sheets 53 on the stationary annular blade base 50 (particularly shown in FIG. 6). Thereby, the water paddle disk 30 is enabled to rotate freely without being interrupted by the blade sheet 53 of the stationary annular blade base 50. The second wheel blade 60 is received within the through hole 52 of the stationary annular blade base 50, has a threaded hole 61 defined at its center to engage to the central axle 12 of the motor 11, and has multiple blade sheets 62 in certain predetermined numbers extending outward and vortically. As shown in FIG. 5, the blade sheets 62 of the second wheel blade 60 align the blade sheets 52 on the stationary annular blade base 50 and the paddle sheets 31 in horizontal and slightly contact with the blade sheets 53 of the stationary annular blade base 50 when the water paddle disk 30 and the auxiliary blade set are assembled within the blade chamber 21 of the lower base 20.

By composing the foregoing described structure, the central axle 12 drives the water paddle disk 30, the auxiliary blade set and the first wheel blade 40 coaxially mounted thereon to rotate synchronously to generate current suction efficiency and to draw precipitation at the bottom of the sewage tank into the lower base 20 via the precipitation inlet 22 when the motor 11 of the pump 10 actuates. The first wheel blade 40 and the gear ring 41 within the precipitation inlet 22 perform a first smashing process to the precipitation and then the second wheel blade 60 cooperating with the stationary annular blade base 50 perform a second smashing process to improve pulverizing efficiency to the precipitation without coagulation. Then smashed precipitation with the sewage is driven by rotation of the paddle sheets 31 on the water paddle disk 30 and drained out via the precipitation outlet 23 and the drain pipe to obtain high efficiency of eliminating the precipitation.

According to above illustration, the sewage pump having the fundamental smashing function performed by water paddle disk 30, the gear ring 41 and the first wheel blade 40 further comprises a stationary annular blasé base 50 and a second wheel blade 60 additionally mounted between the water paddle disk 30 and the first wheel blade 40 to make the sewage pump have two-step smashing function. Wherein, the conventional first wheel blade 40 and the gear ring 41 within the precipitation inlet 22 perform the first smashing process and then the stationary blade base 50 and the second wheel blade 60 perform the second smashing process to ensure the precipitation fluffy and to reduce coagulation and stuck possibility before the precipitation is drained to the water paddle disk 30. Thereby, the sewage pump is improved in operational efficiency and has less malfunction possibility and low repair cost. In summary, the sewage pump of the present invention has excellent industrial utility and practical value.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A sewage pump comprising:

a motor providing the power and having a central axle;

a lower base with a blade chamber attached to the motor and having an inlet and an outlet defined in the lower base to communicate with the blade chamber;

a water paddle disk received inside the blade chamber and mounted on the central axle of the motor;

a gear ring attached to the inlet and a first wheel blade accommodated inside the gear ring and mounted on the central axle;

an auxiliary blade set mounted between the water paddle disk and the first wheel blade and comprising:

a stationary blade base with a through hole and attached to the lower base over the inlet; and a second wheel blade accommodated in the through hole of the stationary blade base and mounted on the central axle of the motor, thereby, the second wheel blade is driven to rotate synchronously with the water paddle disk and the first wheel blade by the central axle of the motor.

2. The sewage pump as claimed in claim 1, wherein the stationary blade base has a top face, multiple first blade sheets formed on the top surface around the through hole in vortex form;

the lower base has a diameter-enlarged recess annularly defined in an inner wall of the blade chamber over the precipitation inlet to snugly engage with the stationary blade base; and the second wheel blade has multiple second blade sheets extending in vortex form to close to the first blade sheets of the stationary blade base.

3. The sewage pump as claimed in claim 2, wherein the water paddle disk has a bottom face and multiple paddle sheets formed on the bottom face in vortex form and aligning to the multiple blade sheets of the stationary blade base in horizontal.

4. The sewage pump as claimed in claim 2, wherein the stationary blade base is combined to the lower base by screws.

5. The sewage pump as claimed in claim 2, wherein each of the multiple first blade sheets of the stationary blade base has a slope face with a sharp inner edge facing the through hole.

6. The sewage pump as claimed in claim 3, wherein the multiple paddle sheets on the water paddle disk are arranged to space from the axle hole with a distance that extends from the axle hole to substantially close to an outer radius of the blade sheets on the stationary blade base.

* * * * *